US006213760B1

(12) United States Patent
Yokoyama

(10) Patent No.: US 6,213,760 B1
(45) Date of Patent: Apr. 10, 2001

(54) BURNER FOR PORTABLE GAS COOKING STOVE

(75) Inventor: Hiroaki Yokoyama, Niigata (JP)

(73) Assignee: Snow Peak, Inc., Niigata (JP)

( * ) Notice: Subject to any disclaimer, the term of this patent is extended or adjusted under 35 U.S.C. 154(b) by 0 days.

(21) Appl. No.: 09/477,800

(22) Filed: Jan. 5, 2000

(30) Foreign Application Priority Data

Jan. 8, 1999 (JP) ..... 11-002872

(51) Int. Cl.[7] ..... F24C 3/10
(52) U.S. Cl. ..... 431/247; 431/264; 431/266
(58) Field of Search ..... 431/247, 263, 431/264, 266, 343, 344; 126/38, 40, 39 E; 361/253

(56) References Cited

U.S. PATENT DOCUMENTS

| | | | | |
|---|---|---|---|---|
| 3,729,288 | * | 4/1973 | Berlincourt et al. | 431/264 |
| 3,917,443 | * | 11/1975 | Adams | 431/264 |
| 3,950,124 | * | 4/1976 | Berry | 431/264 |
| 4,588,373 | * | 5/1986 | Tonon et al. | 431/344 |
| 5,573,393 | | 11/1996 | Tsai . | |
| 5,803,727 | * | 9/1998 | Long | 431/247 |

FOREIGN PATENT DOCUMENTS

| | | |
|---|---|---|
| 2121103 | 11/1972 | (DE) . |
| 703409A1 | 3/1996 | (EP) . |
| 2751053A1 | 1/1998 | (FR) . |
| 1165841 | 10/1969 | (GB) . |
| WO 9809114 | 3/1998 | (WO) . |

* cited by examiner

*Primary Examiner*—Ira S. Lazarus
*Assistant Examiner*—Sara Clarke
(74) *Attorney, Agent, or Firm*—Young & Thompson

(57) ABSTRACT

There is provided a burner to be used for a portable gas cooking stove, including (a) a mixture gas pipe having an open end through which a gas mixture of combustible gas and air is exhausted, (b) a burner head connected to the mixture gas pipe in a hermetically sealed condition and having at least one opening at a surface thereof, the gas mixture blowing out through the opening, and (c) an igniter igniting the gas mixture blowing out through the opening of the burner head, the igniter generating a spark in a direction perpendicular to a flow of the gas mixture blowing out through the opening of the burner head. The burner makes it possible for the spark to make contact with the gas mixture flow in a larger contact area than that of a conventional burner. Accordingly, it is possible to stably ignite the gas mixture, even if the gas mixture has a great flow velocity.

12 Claims, 7 Drawing Sheets

BURNER FOR PORTABLE GAS COOKING STOVE

BACKGROUND OF THE INVENTION

1. Field of the Invention

The present invention relates to a so-called outdoor portable gas cooking stove, and more particularly, to a burner structure of a portable gas cooking stove.

2. Description of the Related Art

FIG. 1 shows an example of a portable gas cooking stove known in the art.

Normally, the portable gas cooking stove 10 includes a gas cartridge 11 filled with compressed combustible gas, and a gas burner 12 mounted detachably on the gas cartridge 11. The gas cartridge 11 and the gas burner 12 are coupled to each other in a hermetically sealed condition through a gasket 13.

The gas burner 12 is comprised of a plug fitting 14 which is connected to the gas cartridge 11 and through which combustible gas supplied from the gas cartridge 11 passes, a gas flow adjusting spindle 15 which adjusts a degree of opening of a gas passage formed inside the plug fitting 14 to thereby adjust a flow of the combustible gas passing through the plug fitting 14, a burner head 16 with a number of openings 16a formed on a surface thereof, a mixing tube 17 connecting the plug fitting 14 to the burner head 16, kettle holders 18 that are fixed on the mixing tube 17 and extend over the burner head 16, and an igniter 19 mounted on a support 19*a*.

The combustible gas is filled in the gas cartridge 11 in a pressurized condition. Hence, when the gas passage is opened by the gas flow adjusting spindle 15, the combustible gas in a pressurized condition enters the mixing tube 17 from the gas cartridge 11 through the plug fitting 14. Thus, the combustible gas enters the mixing tube 17 with a gas flow thereof being adjusted by the gas flow adjusting spindle 15.

The mixing tube 17 is formed with a number of openings 17*a* (only one of them is illustrated in FIG. 1). External air is absorbed into the mixing tube 17 through the openings 17*a* by virtue of negative pressure produced when the combustible gas passes through the mixing tube 17. The combustible gas is mixed with air entering the mixing tube 17 through the openings 17*a*, into a gas mixture of the combustible gas and air.

After the gas mixture enters the burner head 16, the gas is discharged through the openings 16*a*, and is ignited by the electric igniter 19 located in the vicinity of the burner head 16.

The flame of the burning gas mixture heats an object to be heated such as a pan, kettle, food, etc., put on the kettle holders 18.

In general, outdoor appliances, not limited only to portable gas cooking stoves, are required to be small. Regarding a portable gas cooking stove, the gas cartridge 11 cannot be fabricated smaller in size than a practical limit determined to ensure a volume of gas to maintain a gas-burning time required for practical use. Consequently, in a portable gas cooking stove, miniaturization has been focused mainly on the gas burner 12, and more particularly, on the burner head 16.

However, if the burner head 16 is simply reduced in size, a flow of the gas mixture may exceed the proper gas burning rate, because a volume of the burner head 16 becomes smaller relative to a gas flow from the gas cartridge 11, resulting in a greater rate of the gas mixture discharged through the openings 16*a* of the burner head 16.

If the gas mixture is discharged at a great rate, the gas mixture is rarely ignited by the spark generated by the igniter 19, resulting in incomplete combustion of the gas mixture.

In addition, in the gas burner illustrated in FIG. 1, the igniter 19 is supported only by the support 19*a*, resulting in that the igniter 19 cannot be stably fixed relative to a gas flow of the gas mixture discharged through the openings 16*a*. This also causes incomplete combustion of the mixture gas.

SUMMARY OF THE INVENTION

In view of the above-mentioned problems in the conventional gas burners, it is an object of the present invention to provide a burner which is capable of stably igniting a gas mixture discharged from a burner head, and is capable also of stably supporting an igniter to thereby ensure ignition of the gas mixture.

There is provided a burner to be used for a portable gas cooking stove, including (a) a gas mixture pipe having an open end through which a mixture gas of combustible gas and air is exhausted, (b) a burner head connected to the mixture gas pipe in a hermetically sealed condition and having at least one opening at a surface thereof, the gas mixture blowing out through the opening, and (c) an igniter igniting the gas mixture blowing out through the opening of the burner head, the igniter generating a spark in a direction perpendicular to a flow of the gas mixture blowing out through the opening of the burner head.

As illustrated in FIG. 1, the igniter 19 is positioned facing the burner head 16 in the conventional burner. Accordingly, the igniter 19 generates spark in parallel with a flow of a gas mixture discharged through the openings 16*a* of the burner head 16. Thus, a contact area between the spark and the gas mixture flow is relatively small. As a result, if the gas mixture had a great velocity, it was difficult to ignite the gas mixture by spark generated by the igniter 19.

In contrast, the burner in accordance with the present invention includes an igniter which is positioned perpendicularly to a flow of gas mixture discharged through openings of a burner head. As a result, the spark is generated in a direction perpendicularly to a flow of gas mixture. Hence, a contact area between the spark and a flow of gas mixture in the burner in accordance with the present invention is greater than the same in the conventional burner illustrated in FIG. 1.

Hence, the burner in accordance with the present invention makes it possible to stably ignite a gas mixture, even if the gas mixture has a great flow velocity.

It is preferable that the igniter is supported at lower and upper ends thereof by the mixture gas pipe.

It is preferable that the burner further includes an igniter cover in which the igniter is accommodated. The igniter cover is designed to have a projecting portion projecting in a direction, the projecting portion being formed with an opening having a diameter almost equal to a diameter of the mixture gas pipe. The igniter cover is fixed relative to the mixture gas pipe by engaging the projecting portion to the mixture gas pipe.

The igniter may be comprised of (a) a base block extending in a first direction, (b) a pillar extending in a second direction perpendicular to the first direction, (c) an igniter section extending from a summit of the pillar, and (d) a switch movable in the first direction, and the igniter cover may be comprised of (a) a first cover portion covering the base block therewith, and (b) a second cover portion covering the pillar therewith.

It is preferable that the first cover portion has a portion located above the switch and bent upwardly and obliquely.

It is preferable that the igniter is supported by the mixture gas pipe through an igniter support which is comprised of a ring engageable to the mixture gas pipe and a projection fittable into the second cover portion of the igniter cover, the projection being formed with an opening into which the pillar is to be fit.

There is further provided a burner to be used for a portable gas cooking stove, including (a) a gas mixture pipe having an open end through which a gas mixture of combustible gas and air is exhausted, (b) a burner head connected to the mixture gas pipe in a hermetically sealed condition and having at least one opening at a surface thereof, the gas mixture blowing out through the opening, (c) an igniter igniting the gas mixture blowing out through the opening of the burner head, the igniter generating a spark in a direction perpendicular to a flow of the gas mixture blowing out through the opening of the burner head, and (d) a generator comprised of a pipe through which the combustible gas flows, the generator being arranged outside and close to the burner head.

The burner includes the generator. Combustible gas supplied from the gas cartridge passes through the generator, and then, passes through the mixture gas pipe, and is mixed with air into the gas mixture while passing through the mixture gas pipe. Since the generator is located close to the burner head, the generator is heated by burning the gas mixture blowing out of the burner head. Accordingly, the gas mixture passing through the generator is also heated, and is discharged from the burner head at a high temperature.

The gas mixture of combustible gas and air at a higher temperature is more likely to be ignited. Thus, the gas mixture which has been heated during passing through the generator can be readily ignited by the spark generated by the igniter.

It is preferable that the igniter generates the spark between the burner head and the generator.

By arranging the burner head, the generator and the igniter in this order, these three parts can be arranged in a smallest space, ensuring reduction in the size of the burner.

It is preferable that the generator is reverse U-shaped, and that the igniter is positioned surrounded by the generator when viewed from a front of the generator.

By arranging the igniter within the generator, the generator acts as a windscreen for the igniter. As a result, a flow of the gas mixture discharged through the openings of the burner head can be stabilized, ensuring stable ignition of the gas mixture.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 2:
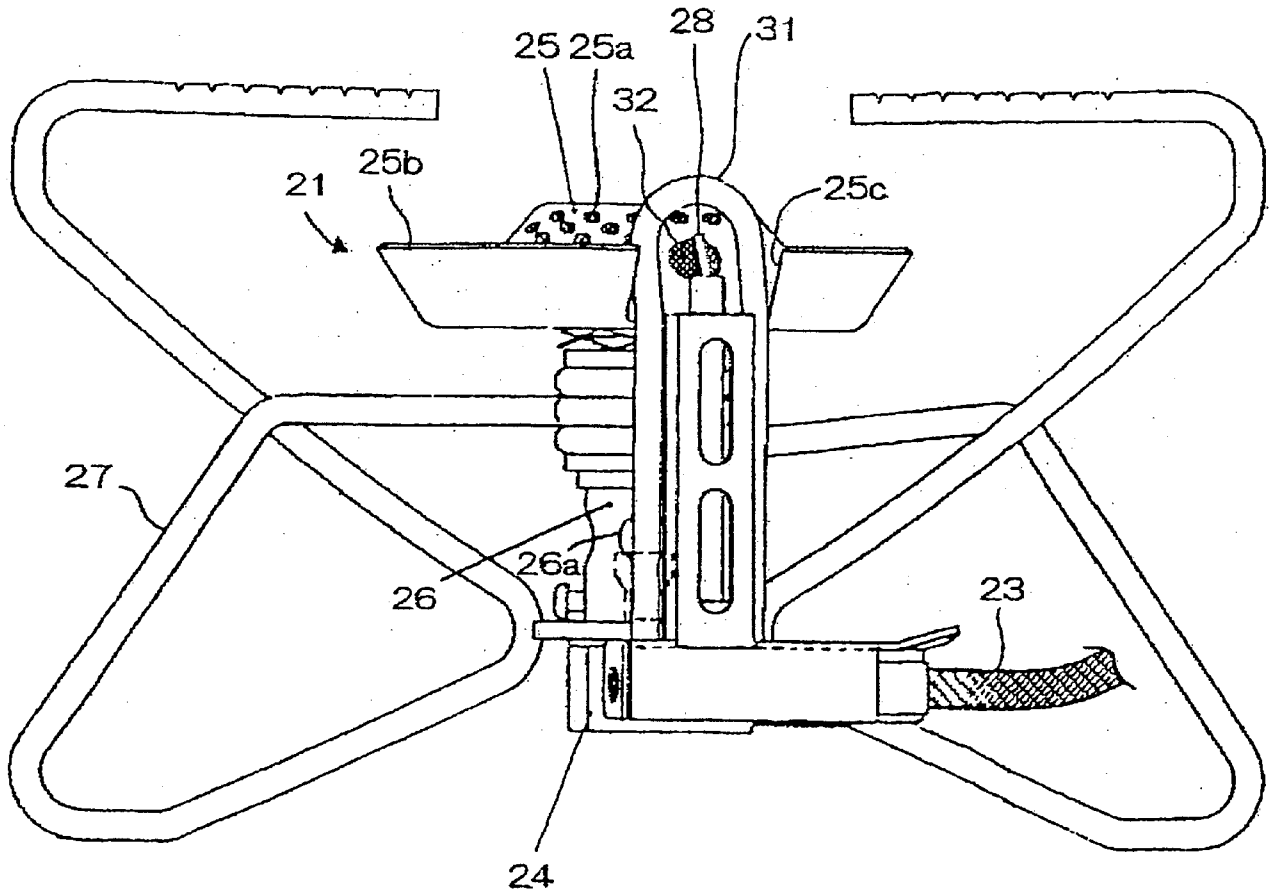
FIG. 2 is a front view of a gas cooking stove including the burner in accordance with the present invention.
Figure 3:
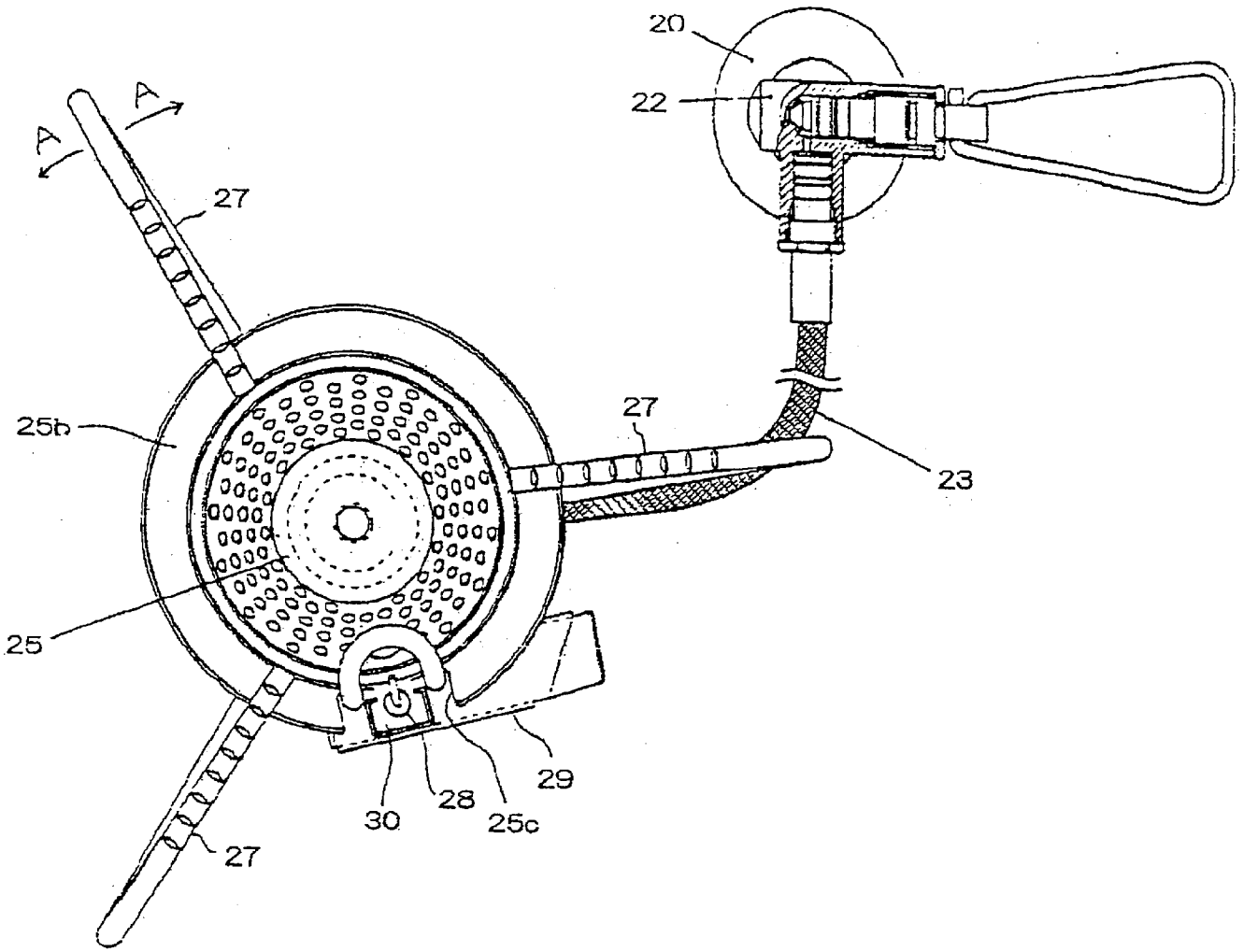
FIG. 3 is a top plan view of the gas cooking stove illustrated in FIG. 2.

FIGS. 2 and 3 illustrate a gas cooking stove including the burner in accordance with a preferred embodiment.

As illustrated in FIGS. 2 and 3, the gas cooking stove is comprised of a gas cartridge 20 (illustrated only in FIG. 3) filled with pressurized combustible gas, a gas burner 21 to which combustible gas is supplied from the gas cartridge 20 and which burns the combustible gas, a plug fitting 22 adjusting a flow of the combustible gas supplied from the gas cartridge 20, and a gas tube 23 through which the combustible gas is supplied from the gas cartridge 20 to the gas burner 21.

The gas burner 21 is comprised of a joint block 24 to which the gas tube 23 is connected, a burner head 25 having a number of openings 25*a* at a surface thereof, a saucer-shaped windshield 25*b* surrounding the burner head 25, a mixing tube 26 connecting the joint block 24 to the burner head 25, kettle holders 27 connected to the mixing tube 26, and an igniter 28 igniting the gas mixture of air and the combustible gas, discharged from the burner head 25 through the openings 25*a*.

Each of the kettle holders 27 is wound at one end thereof around the mixing tube 26, and is designed to be swingable in directions indicated with arrows A in FIG. 3.

Figure 4A:
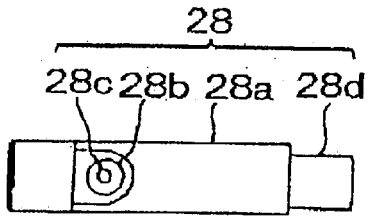
FIG. 4A is a top plan view of an igniter.
Figure 4B:
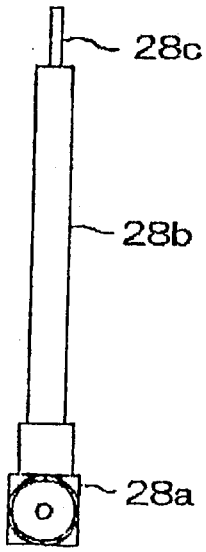
FIG. 4B is a front view of the igniter illustrated in FIG. 4A.
Figure 4C:
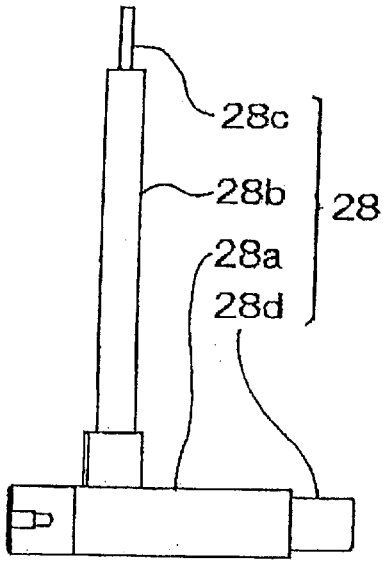
FIG. 4C is a side view of the igniter illustrated in FIG. 4A.

FIGS. 4A to 4C illustrate a structure of the igniter 28. The igniter 28 is comprised of a base block 28*a* in the form of a square pole, a cylindrical pillar 28*b* upwardly extending from the base block 28*a*, an igniter section 28*c* upwardly extending from an upper end of the pillar 28*b* and generating a spark, and a switch 28*d* activating the igniter 28 when pushed relative to the base block 28*a*.

Figure 5A:
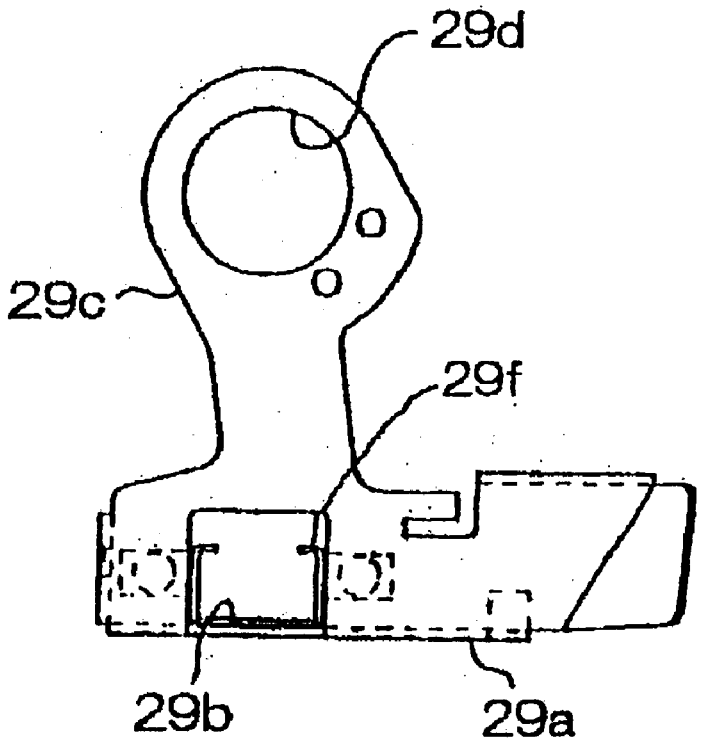
FIG. 5A is a top plan view of an igniter cover.
Figure 5B:
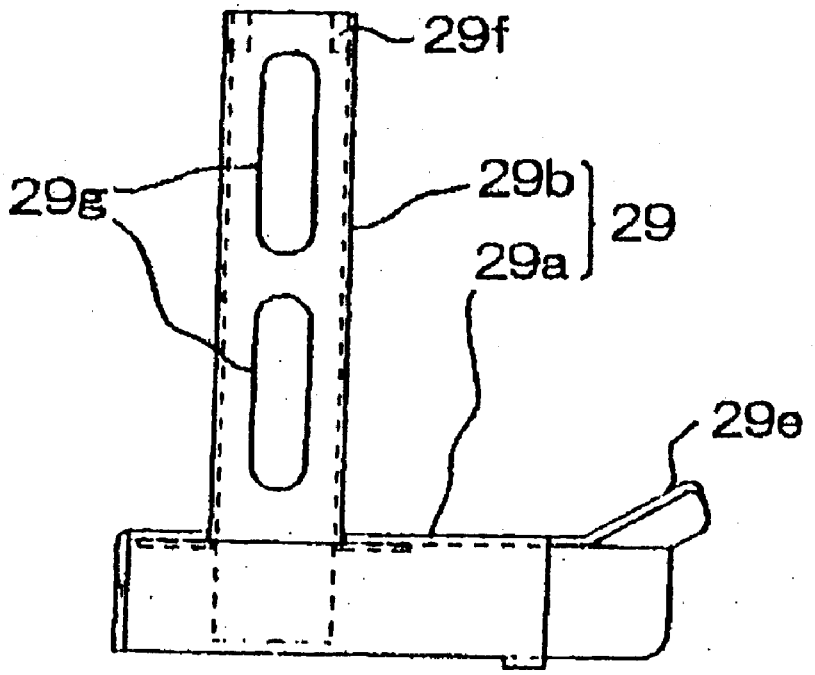
FIG. 5B is a side view of the igniter cover illustrated in FIG. 5A.

The igniter 28 is accommodated in an igniter cover 29 illustrated in FIGS. 5A and 5B. The igniter cover 29 is comprised of a first cover portion 29*a* and a second cover portion 29*b*.

The first cover portion 29*a* is open at a bottom thereof. The base block 28*a* of the igniter 28 is accommodated in the first cover portion 29*a*.

As illustrated in FIG. 5A, the first cover portion 29*a* is formed at an upper surface thereof with a projecting portion 29*c*. The projecting portion 29*c* is formed with a circular opening 29*d*. The igniter cover 29 is fixed relative to the mixing tube 26 by inserting the mixing tube 26 into the circular opening 29*d*.

The first cover portion 29*a* is formed at an upper surface at an end through which the switch 28*d* is inserted, with an inclined portion 29*e* obliquely, upwardly and outwardly inclining. Hence, the switch 28*d* can be readily pushed.

The pillar 28*b* of the igniter 28 is accommodated in the second cover portion 29*b*. The second cover portion 29*b* has a rectangular cross-section, and is open at a side. As illustrated in FIG. 5A, the second cover portion 29*b* is formed at upper ends thereof with hookers 29*f* formed by inwardly bending walls of the second cover portion 29*b*.

The second cover portion 29*b* is formed with vertically arranged oval openings 29*g* for diffusing heat from the igniter 28.

The igniter cover 29 can be formed by, for instance, separately fabricating the first cover portion 29*a* and the second cover portion 29*b*, and welding them to each other.

Figure 6:
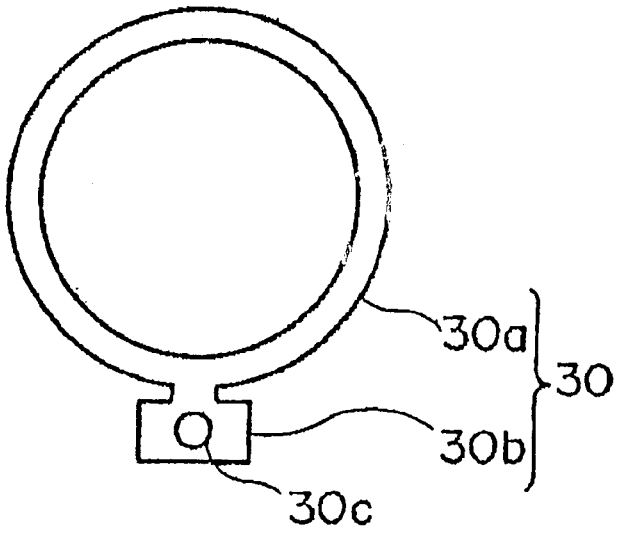
FIG. 6 is a plan view of an igniter support.

FIG. 6 is a plan view of an igniter support 30 which supports the igniter 28 at an upper end thereof.

The igniter support 30 is comprised of a ring 30*a* and a rectangular portion 30*b* outwardly projecting from the ring 30*a*.

The ring 30*a* is designed to have such an inner diameter that the ring 30*a* can be engaged to the mixing tube 26 just below the burner head 25.

The rectangular portion 30*b* is designed to have the same size as a rectangular cross-section of the second cover portion 29*b*. Hence, the rectangular portion 30*b* can be inserted into the second cover portion 29*b*.

The rectangular portion 30*b* is formed centrally with a circular opening 30*c*. The circular opening 30*c* is designed to have a diameter equal to a diameter of the pillar 28*b* of the igniter 28. Accordingly, the pillar 28*b* can be fit into the circular opening 30*c* of the rectangular portion 30*b*.

When the igniter 28 is to be accommodated in the igniter cover 29, the ring 30*a* is engaged to the mixing tube 26 and the rectangular portion 30*b* is inserted into the second cover portion 29*b*. Then, the igniter 28 is positioned below the igniter cover 28, and then, is upwardly inserted into the igniter cover 29. Thus, the base block 28*a* is accommodated in the first cover portion 29*a*, and the pillar 28*b* is accommodated in the second cover portion 29*b*.

Then, as illustrated in FIG. 3, pillar 28*b* is inserted in the vicinity of an upper end thereof into the circular opening 30*c* of the igniter support 30.

Thus, the opening 29*d* formed in the projecting portion 29*c* is fit around the mixing tube to thereby ensure that the igniter 28 is fixed at a lower end thereof relative to the gas burner 21 and hence the mixing tube 26, and the opening 30*c* formed in the rectangular portion 30*b* is fit into the pillar 28*b* of the igniter 28 to thereby ensure that the igniter 28 is fixed at an upper end thereof relative to the gas burner 21 and hence the mixing tube 26.

Figure 7A:
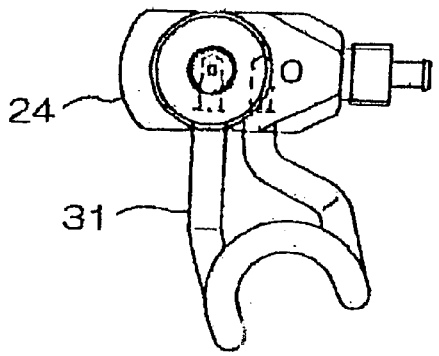
FIG. 7A is a top plan view of a generator.
Figure 7B:
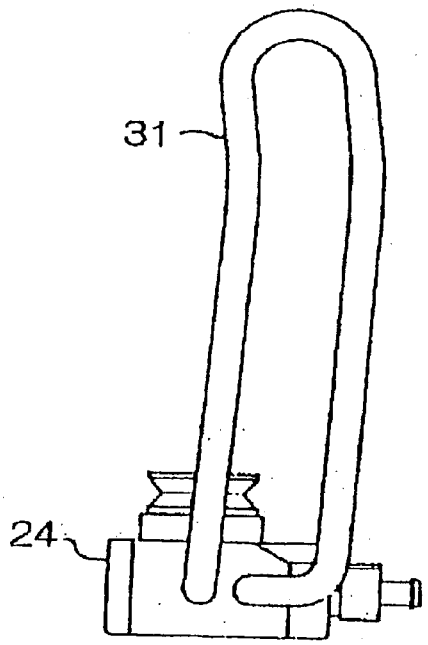
FIG. 7B is a front view of the generator illustrated in FIG. 7A.
Figure 7C:
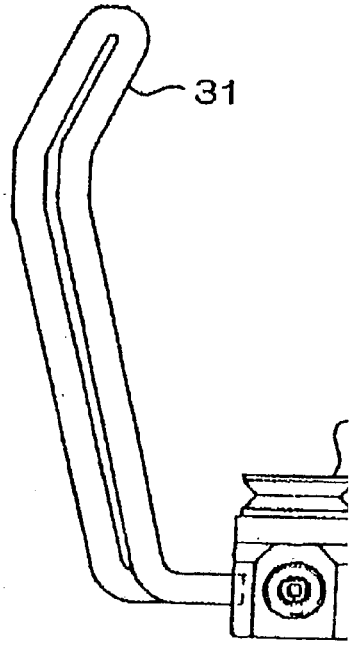
FIG. 7C is a side view of the generator illustrated in FIG. 7A.

FIGS. 7A to 7C illustrates a generator 31. The generator 31 is comprised of a hollow, reverse-U shaped pipe, and is connected at a free end thereof to the joint block 24.

The combustible gas having been supplied from the gas cartridge 20 through the plug fitting 22 and the gas tube 23 passes through the joint block 24, and then, through the generator 31, and returns to the joint block 24. Thereafter, the combustible gas is supplied to the mixing tube 26 from the joint block 24.

As illustrated in FIGS. 2 and 3, the windshield 25*b* is formed with a cutout 25*c*. The generator 31 is positioned close to the burner head 25 in the cutout 25*c*. The generator 31 is designed to have such a height that a summit of the generator 31 is either almost level with or slightly higher than a summit of the burner head 25.

When viewed from the burner head 25, the igniter 28 is located slightly outside the generator 31. When viewed horizontally, the igniter 28 is completely surrounded by the generator 31.

As illustrated in FIG. 2, the burner head 25 is formed at a surface thereof with a flame hole 32 as well as the openings 25*a*. The flame hole 32 has a greater size than a size of the opening 25*a*. A mesh sheet is arranged all over the flame hole 32. The igniter 28 is positioned such that the igniter section 28*c* faces the flame hole 32. In this embodiment, the igniter section 28*c* is slightly inclined towards the flame hole 32.

The gas cooking stove in the instant embodiment is used as follows.

The combustible gas under pressure is adjusted in a flow rate in the plug fitting 22, and then, is supplied to the joint block 24 through the gas tube 23. Then, the combustible gas is supplied to the generator 31 from the joint block 24.

Since the generator 31 is positioned close to the burner head 25 as mentioned earlier, the generator 31 is heated by burning combustible gas blowing out from the burner head 25. Accordingly, the gas mixture passing through the generator 31 is also heated, and then, supplied to the mixing tube 26.

The mixing tube 26 is formed at a surface thereof with a plurality of openings 26*a*. External air is absorbed into the mixing tube 26 through the openings 26*a* by virtue of negative pressure generated when the combustible gas passes the mixing tube 26. Thus, the combustible gas is mixed with air into a gas mixture of air and combustible gas.

After entering the burner head 25, the gas mixture blows out through the openings 25*a*, and is ignited by the igniter 28 located in the vicinity of the burner head 25. The thus ignited gas mixture is burnt, and as a result, flame blows out through the openings 25*a*.

The flame heats cooking appliances and/or food (not illustrated) put on the kettle holders 27.

In the instant embodiment, the igniter section 28*c* is positioned perpendicular to a flow of the gas mixture discharged through the openings 25*a*. Hence, the spark generated by the igniter section 28*c* flies perpendicularly to a flow of the gas mixture.

Figure 1:
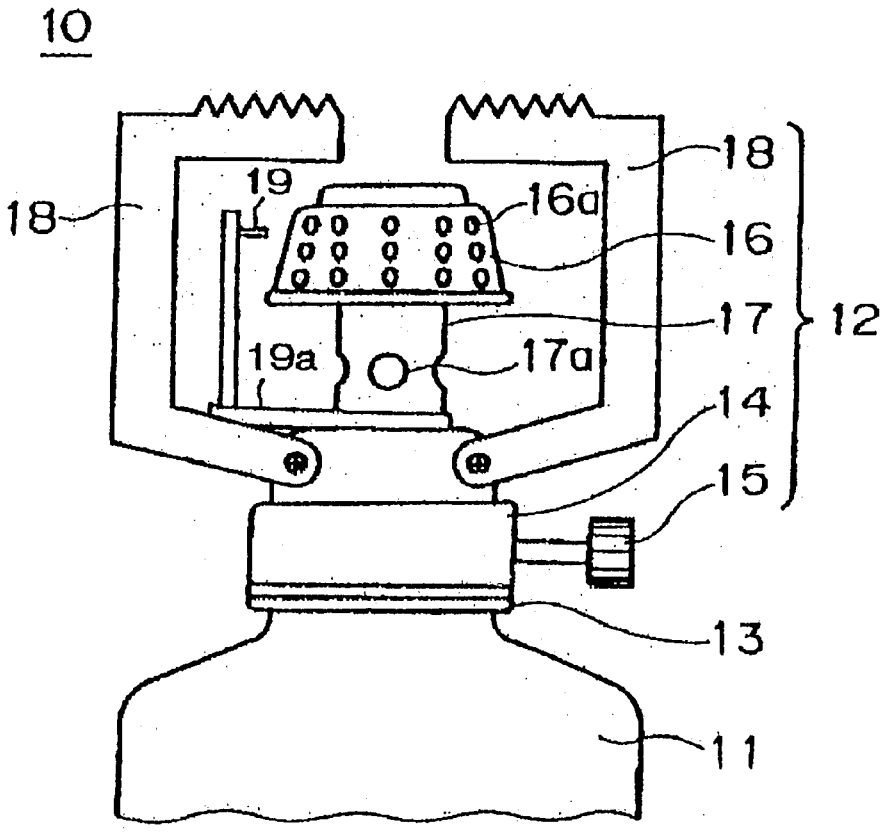
FIG. 1 PRIOR ART
FIG. 1 is a front view of a conventional portable gas cooking stove.

In the conventional burner illustrated in FIG. 1, the spark generated by the igniter 19 flies in parallel with a flow of the gas mixture. Hence, a contact area of the spark with the gas mixture was relatively small.

In contrast, the spark flies perpendicularly to a flow of gas mixture in the instant embodiment. As a result, a contact area of the spark with the gas mixture is greater than the same in the conventional burner. Hence, even if the gas mixture had a great velocity, it would be possible to stably ignite the gas mixture.

The gas mixture of combustible gas and air at higher temperature is more likely to be ignited. Thus, the gas mixture which has been heated during passing through the generator 31 can be readily ignited by the spark generated by the igniter 28.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 11-2872 filed on Jan. 8, 1999 including specification, claims, drawings and summary is incorporated herein by reference in its entirety.

What is claimed is:

1. A burner to be used for a portable gas cooking stove, comprising:

(a) a mixture gas pipe having an open end through which a gas mixture of combustible gas and air is exhausted;

(b) a burner head connected to said mixture gas pipe in a hermetically sealed condition and having at least one opening at a surface thereof, said gas mixture blowing out through said opening; and (c) an igniter igniting said gas mixture blowing out through said opening of said burner head, said igniter generating a spark in a direction perpendicular to a flow of said gas mixture blowing out through said opening of said burner head; and said igniter being supported at lower and upper ends thereof by said mixture gas pipe.

2. The burner as set forth in claim 1, further comprising an igniter cover in which said igniter is accommodated, said igniter cover having a projecting portion projecting in a direction, said projecting portion being formed with an opening having a diameter almost equal to a diameter of said mixture gas pipe, said igniter cover being fixed relative to said gas mixture pipe by engaging said projecting portion to said mixture gas pipe.

3. The burner as set forth in claim 2, wherein said igniter is comprised of:

(a) a base block extending in a first direction;

(b) a pillar extending in a second direction perpendicular to said first direction;

(c) an igniter section extending from a summit of said pillar; and (d) a switch movable in said first direction, and wherein said igniter cover is comprised of:

(a) a first cover portion covering said base block therewith; and (b) a second cover portion covering said pillar therewith.

4. The burner as set forth in claim 3, wherein said first cover portion has a portion located above said switch and bent upwardly and obliquely.

5. The burner as set forth in claim 3, wherein said igniter is supported by said mixture gas pipe through an igniter support, said igniter support being comprised of a ring engageable to said mixture gas pipe and a projection fittable into said second cover portion of said igniter cover, said projection being formed with an opening into which said pillar is to be fit.

6. A burner to be used for a portable gas cooking stove, comprising:

(a) a mixture gas pipe having an open end through which a gas mixture of combustible gas and air is exhausted;

(b) a burner head connected to said mixture gas pipe in a hermetically sealed condition and having at least one opening at a surface thereof, said gas mixture blowing out through said opening;

(c) an igniter igniting said gas mixture blowing out through said opening of said burner head, said igniter generating a spark in a direction perpendicular to a flow of said gas mixture blowing out through said opening of said burner head; and (d) a generator comprised of a pipe through which said combustible gas flows, said generator being arranged outside and close to said burner head; said igniter generating a spark between said burner head and said generator.

7. The burner as set forth in claim 6, wherein said generator is reverse U-shaped, and wherein said igniter is positioned surrounded by said generator when viewed from a front of said generator.

8. The burner as set forth in claim 6, wherein said igniter is supported at lower and upper ends thereof by said mixture gas pipe.

9. The burner as set forth in claim 8, further comprising an igniter cover in which said igniter is accommodated, said igniter cover having a projecting portion projecting in a direction, said projecting portion being formed with an opening having a diameter almost equal to a diameter of said gas mixture pipe, said igniter cover being fixed relative to said gas mixture pipe by engaging said projecting portion to said mixture gas pipe.

10. The burner as set forth in claim 9, wherein said igniter is comprised of:

(a) a base block extending in a first direction;

(b) a pillar extending in a second direction perpendicular to said first direction;

(c) an igniter section extending from a summit of said pillar; and (d) a switch movable in said first direction, and wherein said igniter cover is comprised of:

(a) a first cover portion covering said base block therewith; and (b) a second cover portion covering said pillar therewith.

11. The burner as set forth in claim 10, wherein said first cover portion has a portion located above said switch and bent upwardly and obliquely.

12. The burner as set forth in claim 10, wherein said igniter is supported by said mixture gas pipe through an igniter support, said igniter support being comprised of a ring engageable to said mixture gas pipe and a projection fittable into said second cover portion of said igniter cover, said projection being formed with an opening into which said pillar is to be fit.

* * * * *